US005565876A

United States Patent [19]

Murakami et al.

[11] Patent Number: 5,565,876

[45] Date of Patent: Oct. 15, 1996

[54] WINDOW GLASS ANTENNA

[75] Inventors: Harunori Murakami; Hidetoshi Oka, both of Osaka, Japan

[73] Assignee: Nippon Sheet Glass Co., Ltd., Osaka, Japan

[21] Appl. No.: 430,159

[22] Filed: Apr. 27, 1995

Related U.S. Application Data

[63] Continuation of Ser. No. 15,253, Feb. 8, 1993, abandoned, which is a continuation of Ser. No. 796,068, Nov. 20, 1991, abandoned.

[30] Foreign Application Priority Data

Nov. 21, 1990 [JP] Japan ..... 2-122239

[51] Int. Cl.[6] ..... H01Q 1/32

[52] U.S. Cl. ..... 343/713; 343/841

[58] Field of Search ..... 343/713, 878, 343/841, 842; H01Q 1/32

[56] References Cited

U.S. PATENT DOCUMENTS

| | | | |
|---|---|---|---|
| 3,766,563 | 10/1973 | Sauer et al. | 434/713 |
| 3,771,159 | 11/1973 | Kawaguchi et al. | 343/713 |
| 4,331,961 | 5/1982 | Davis | 343/713 |
| 5,079,560 | 1/1992 | Sakurai et al. | 343/713 |

FOREIGN PATENT DOCUMENTS

| | | | |
|---|---|---|---|
| 6911585 | 12/1969 | Germany . | |
| 2336320 | 2/1975 | Germany | 343/713 |
| 61-222302 | 10/1986 | Japan . | |
| 62-132402 | 6/1987 | Japan . | |
| 1-146614 | 10/1989 | Japan . | |
| 1-292902 | 11/1989 | Japan . | |

*Primary Examiner*—Michael C. Wimer
*Attorney, Agent, or Firm*—Merchant, Gould, Smith, Edell, Welter & Schmidt, P.A.

[57] ABSTRACT

A window glass antenna has a receiving antenna pattern and a loop-shaped guard pattern of an electrically conductive material disposed on a sheet of window glass around the receiving antenna pattern. The guard pattern is positioned on the sheet of window glass for intensive electromagnetic and electrostatic coupling between the guard pattern and an electric conductor disposed around the sheet of window glass. The guard pattern and the electric conductor are spaced from each other by a distance of 2 mm or less. The guard pattern has a width of 1 mm or more.

2 Claims, 3 Drawing Sheets

WINDOW GLASS ANTENNA

This is a continuation of application Ser. No. 08/015,253, filed on Feb. 8, 1993, now abandoned, which is a continuation of application Ser. No. 07/796,068, filed on Nov. 20, 1991, now abandoned.

BACKGROUND OF THE INVENTION

1. Field of the Invention

The present invention relates to a radio signal receiving antenna Comprising an electric conductor attached to a sheet of window glass of an automobile or a building.

2. Description of the Prior Art

FIG. 7 of the accompanying drawings schematically shows a known window glass antenna for automobiles as disclosed in Japanese Laid-Open Utility Model Publication No. 1-146614 published on Oct. 9, 1989.

The conventional window glass antenna, generally designated by the reference numeral 101 in FIG. 7, comprises a plurality of loop-shaped receiving antenna patterns 103 attached to a sheet of window glass 102 and spaced inwardly from the outer peripheral edge thereof, and a connector 104 connected to the receiving antenna patterns 103, the connector 104 serving to pick up received radio signals.

The receiving antenna patterns 103 are interrupted by respective gaps 105, 106, 107 defined therein, so that the receiving antenna patterns 103 have different effective lengths, respectively.

The window glass antenna 101 as it is attached to a window glass sheet may not be able to receive desired radio signals with good sensitivity depending on the configurations of the automobile body on which the window glass antenna 101 is mounted.

FIG. 8 of the accompanying drawings illustrates in cross section the window glass antenna 101 that is mounted on an automobile body.

As shown in FIG. 8, the window glass sheet 102 is attached to the automobile body by a window frame 108 having a flange 109. More specifically, the window glass sheet 102 is bonded to the flange 109 through an adhesive gasket 110, and sealed with respect to the window frame 108 by a gasket 111. The frequency vs. sensitivity characteristic of the window glass antenna 101 is not determined by the shape of the receiving antenna patterns 103 only, but is governed by the shape of the receiving antenna patterns 103 and also by the electromagnetic and electrostatic coupling between the antenna patterns 103 and the window frame 108 and the flange 109, which are an electric conductors.

Therefore, in the case where the window glass antenna 101 is mounted on an automobile body, its frequency vs. sensitivity characteristic is affected by an electric conductor of the automobile body, and in the case where the window glass antenna 101 is mounted on a window frame of a building, its frequency vs. sensitivity characteristic is affected by an electric conductor of the window frame or the building.

SUMMARY OF THE INVENTION

In view of the drawbacks of the conventional window glass antenna, it is an object of the present invention to provide a window glass antenna having a sensitivity to radio signals which is less susceptible to an electric conductor of an automobile or a building on which the window glass antenna is mounted.

According to the present invention, a window glass antenna having a receiving antenna pattern disposed on a sheet of window glass, characterized in that a loop-shaped guard pattern of an electrically conductive material is disposed on the sheet of window glass around the receiving antenna pattern on the sheet of window glass.

The guard pattern is positioned on the sheet of window glass for intensive electromagnetic and electrostatic coupling between the guard pattern and an electric conductor disposed around the sheet of window glass.

The guard pattern and the electric conductor are spaced from each other by a distance of at most 2 mm.

The guard pattern has a width of at least 1 mm.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
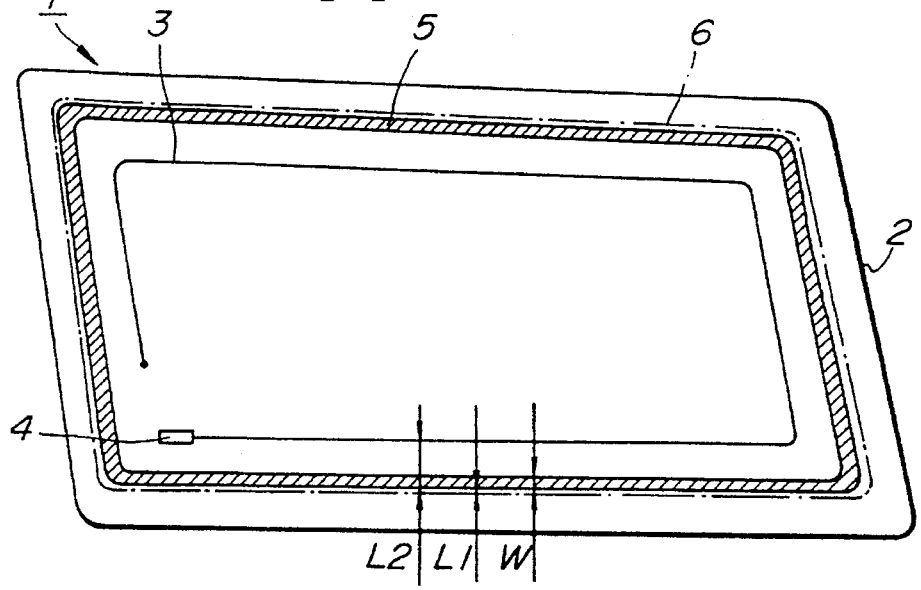
FIG. 1 is a schematic plan view of a window glass antenna for receiving FM broadcasts according to a first embodiment of the present invention.

Like or corresponding parts are denoted by like or corresponding reference characters throughout views.

FIG. 1 schematically shows a window glass antenna for receiving FM broadcasts according to a first embodiment of the present invention.

The window glass antenna, generally designated by the reference numeral 1, includes a receiving antenna pattern 3, a radio signal pickup area 4, and a guard pattern 5. The patterns 3, 5 and the radio signal pickup area 4 may be formed of a printed and baked paste material that is electrically conductive.

The receiving antenna pattern 3 is in the shape of a substantially rectangular loop and has an effective length selected in view of the wavelengths of the FM broadcast band. The window glass antenna 1 may have a plurality of receiving antenna patterns 3.

The guard pattern 5 extends as a closed loop around the receiving antenna pattern 3. The guard pattern 5 has an outer peripheral edge that is spaced a distance L1 inwardly from an inner peripheral edge 6 (indicated by the dot-and-dash line) of an electric conductor (not shown) of a support or an attachment for the window glass antenna 1. In the illustrated embodiment, the distance L1 is 1 mm, and the guard pattern 5 has a width W of 3 mm.

More specifically, the receiving antenna pattern 3 is disposed on a window glass sheet 2 in radially inwardly spaced relationship to the inner peripheral edge 6, and the guard pattern 5 is of a loop shape extending along the inner peripheral edge 6. The guard pattern 5 is disposed on the window glass sheet 2 between the inner peripheral edge 6 and the receiving antenna pattern 3, but more closely to the inner peripheral edge 6 than to the receiving antenna pattern 3.

Figure 8:
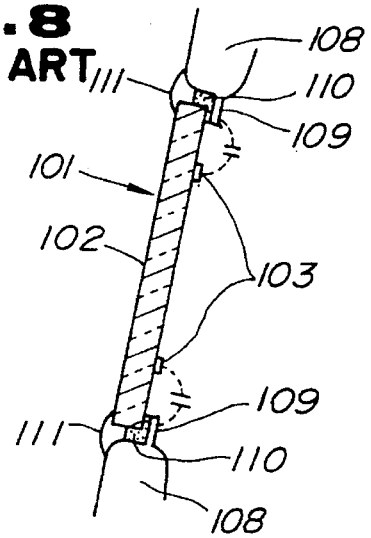
FIG. 8 PRIOR ART
FIG. 8 is a fragmentary cross-sectional view of the window glass antenna shown in FIG. 7, as attached to an automobile body.

Actually, the inner peripheral edge 6 is the inner peripheral edge of the flange 109 (see FIG. 8) of an automobile window frame or a metallic window frame of a building.

The receiving antenna pattern 3 is spaced inwardly from the inner peripheral edge 6 by a distance L2 of 15 mm.

Figure 2:
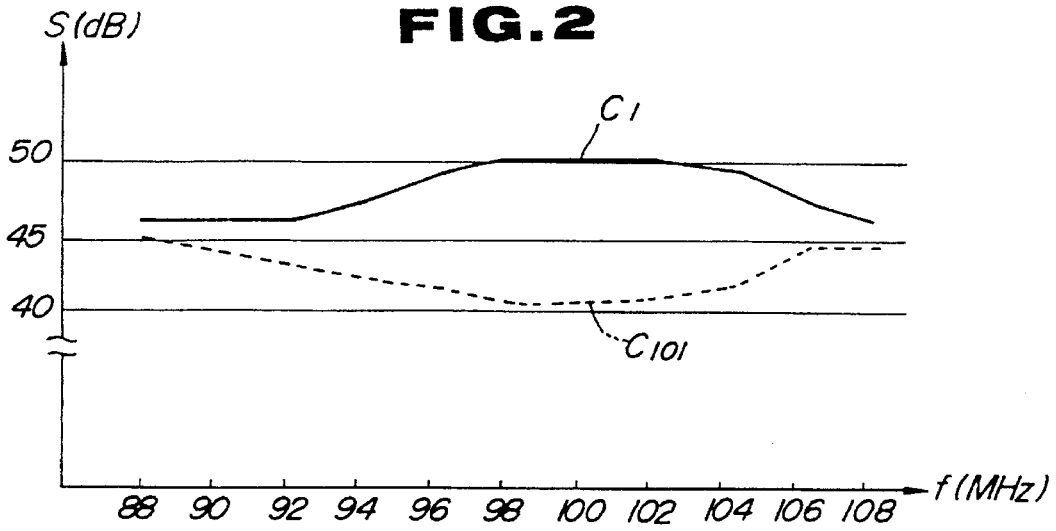
FIG. 2 is a graph showing the frequency vs. sensitivity characteristic of the window glass antenna shown in FIG. 1.
Figure 7:
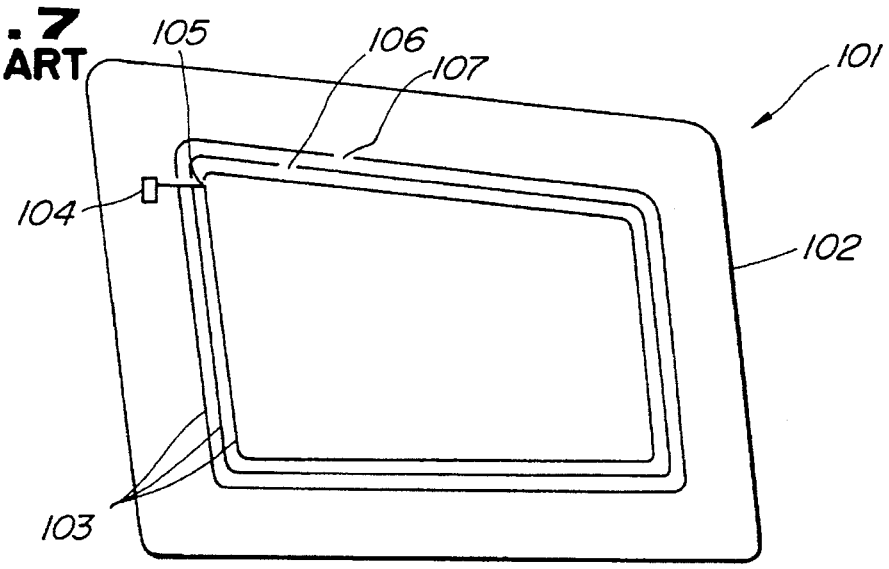
FIG. 7 PRIOR ART
FIG. 7 is a schematic plan view of a conventional window glass antenna.

FIG. 2 Shows the frequency vs. sensitivity characteristic of the window glass antenna 1 shown in FIG. 1. The graph of FIG. 2 has a horizontal axis representing the frequency f of the FM broadcast band, and a vertical axis representing the radio signal reception sensitivity S (dB) of the window glass antenna 1. The frequency vs. sensitivity characteristic of the window glass antenna 1 is indicated by a characteristic curve C1, whereas the frequency vs. sensitivity characteristic of the conventional window glass antenna 101 shown in FIG. 7 is indicated by a characteristic curve C101.

As can be understood from FIG. 2, the guard pattern 5 is effective to increase the radio signal reception sensitivity S by 1~9 dB. The measurements were conducted on samples having a guard pattern width of 3 mm in an electric field whose intensity is 60 dBμV/m.

Figure 3:
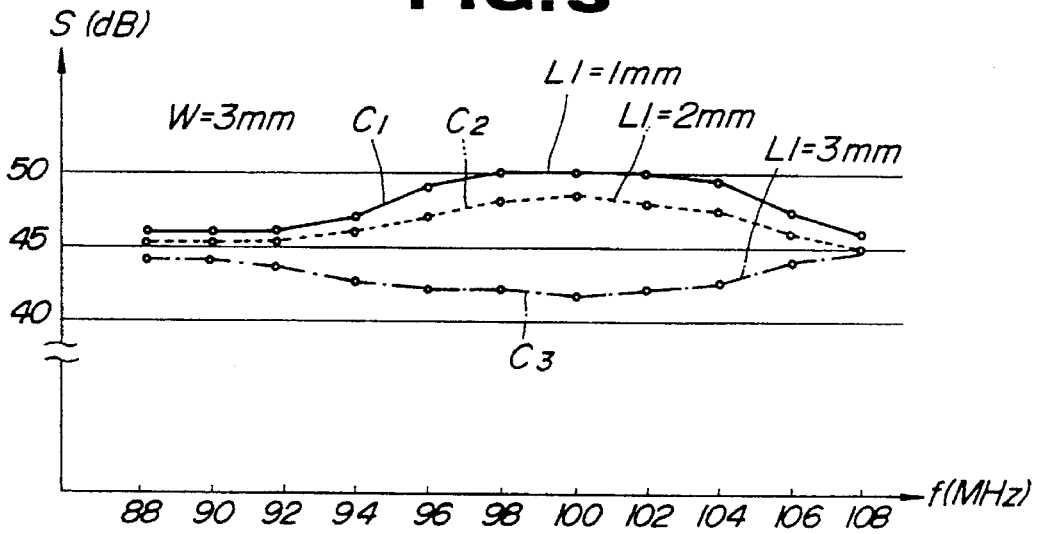
FIG. 3 is a graph showing the frequency vs. sensitivity characteristics of the window glass antenna shown in FIG. 1, with different distances L1 between an edge of an antenna support and a guard pattern of the antenna.

FIG. 3 shows the frequency vs. sensitivity characteristics of the window glass antenna 1 shown in FIG. 1, with different distances L1. The graph of FIG. 3 shows a characteristic curve C1 plotted with the distance L1 of 1 mm, a characteristic curve C2 plotted with the distance L1 of 2 mm, and a characteristic curve C3 plotted with the distance L1 of 3 mm. The characteristic curve C1 remains the same throughout FIGS. 2, 3, 4, and 6.

Study of FIG. 3 indicates that the radio signal reception sensitivity S increases when the distance L1 is 2 mm or less.

Figure 4:
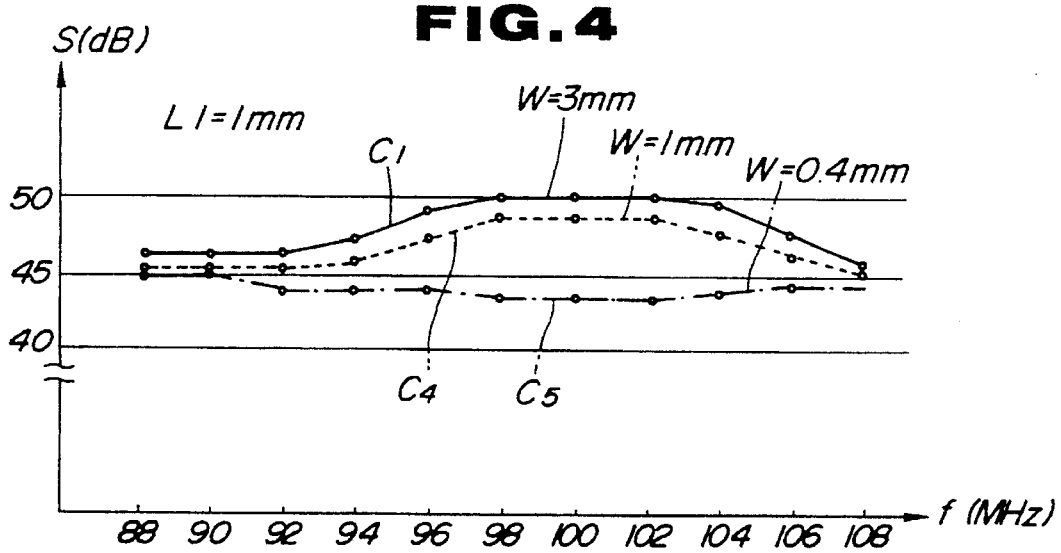
FIG. 4 is a graph showing the frequency vs. sensitivity characteristics of the window glass antenna shown in FIG. 1, with different guard pattern widths.

FIG. 4 shows the frequency vs. sensitivity characteristics of the window glass antenna 1 shown in FIG. 1, with different widths W but the distance L1 kept at 1 mm. The graph of FIG. 4 shows a characteristic curve C1 plotted with the width W of 3 mm, a characteristic curve C4 plotted with the width W of 1 mm, and a characteristic curve C5 plotted with the width W of 0.4 mm.

It can be understood from FIG. 4 that the radio signal reception sensitivity S increases when the width W of the guard pattern 5 increases.

Figure 5A:
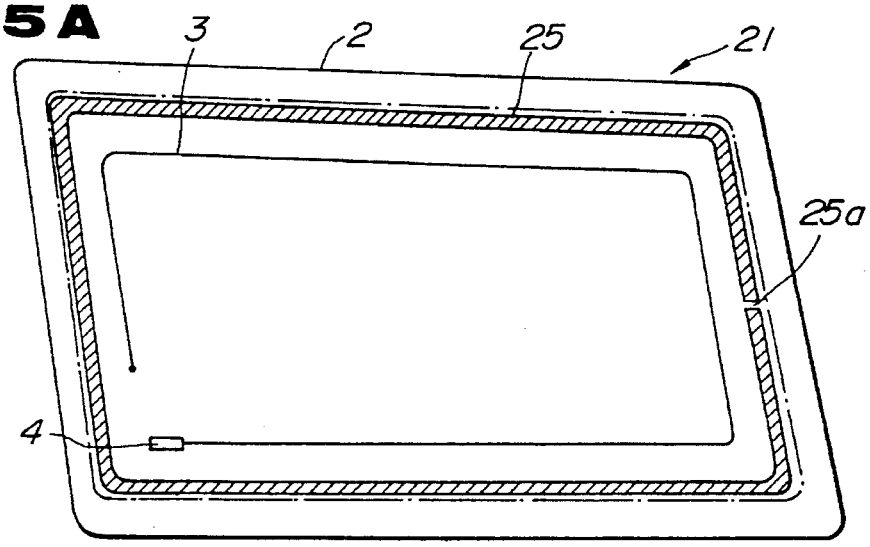
FIGS. 5A and 5B are schematic plan views of window glass antennas according to second and third embodiments, respectively, of the present invention.
Figure 5B:
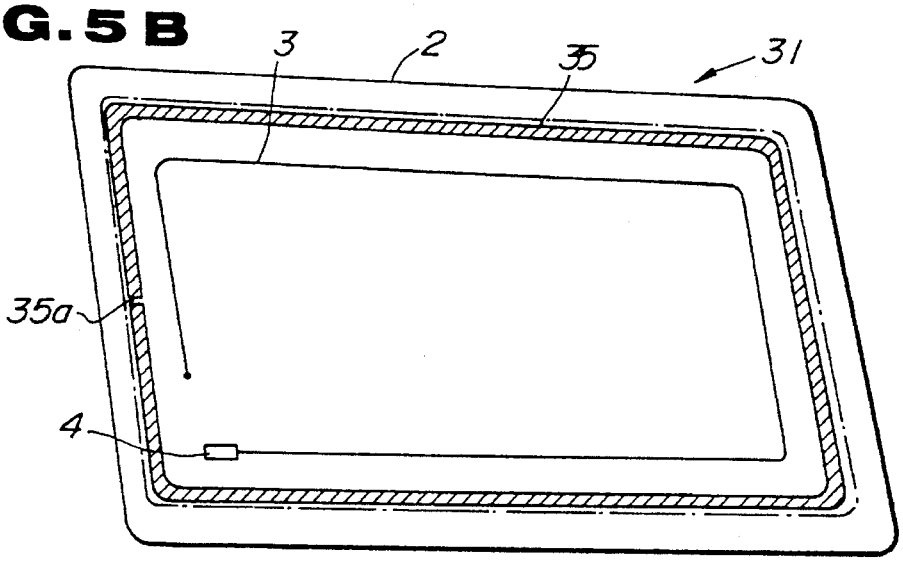

FIGS. 5A and 5B show window glass antennas 21, 31, respectively, according to second and third embodiments of the present invention. The window glass antennas 21, 31 include respective guard patterns 25, 35 each in the shape of an open loop with respective gaps 25*a*, 35*a*. With the window glass antennas 21, 31, loop currents in the guard patterns 25, 35 are interrupted by the gaps 25*a*, 35*a*.

Figure 6:
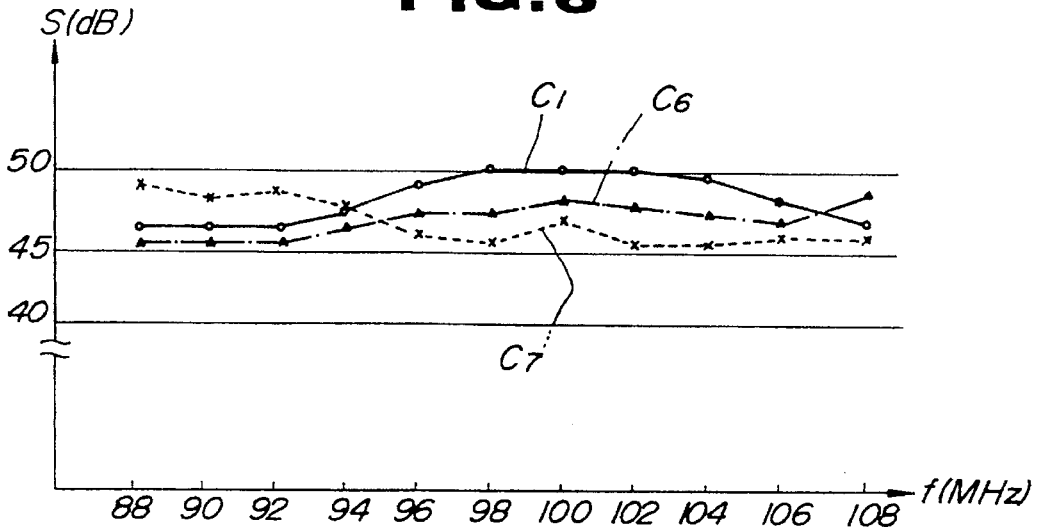
FIG. 6 is a graph showing the frequency vs. sensitivity characteristics of the window glass antennas shown in FIGS. 5A and 5B.

FIG. 6 schematically shows the frequency vs. sensitivity characteristics of the window glass antennas 21, 31 shown in FIGS. 5A and 5B. The graph of FIG. 6 shows characteristic curves C6, C7 of the window glass antennas 21, 31, respectively.

It can be seen from FIG. 6 that the frequency vs. sensitivity characteristics of the window glass antennas 21, 31 can be varied by providing the gaps in the guard patterns 25, 35, i.e., by varying the shapes of the guard patterns 25, 35. The window glass antennas 21, 31 can therefore be designed for reduced sensitivity differences or deviations over the entire FM broadcast band.

In the window glass antennas 1, 21, 31, the guard patterns 5, 25, 35 are disposed around the receiving antenna pattern 3. Therefore, even when the support or attachment for the window glass sheet 2 is electrically conductive, the window glass antennas 1, 21, 31 have good frequency vs. sensitivity characteristics C1, C2, C4, C6, C7 without sensitivity reductions which would otherwise be caused by such electrical conductor.

The distance L1 between the guard patterns 5, 25, 35 and the inner peripheral edge 6 of the window glass support or attachment is 2 mm or less for intensive electromagnetic and electrostatic coupling therebetween, and the width W of the guard patterns 5, 25, 35 is 1 mm or more for reducing the electric resistance (i.e., increasing the electric conductivity) of the guard patterns 5, 25, 35. Such dimensional selections allow the impedance between the receiving antenna pattern 3 and the automobile body, for example, to be adjusted for higher radio signal reception sensitivity.

In summary, the guard patterns 5, 25, 35 disposed between the receiving antenna pattern 3 and the inner peripheral edge 6 of the electric conductor of the window glass support or attachment are effective to reduce the intensity of the electromagnetic and electrostatic coupling between the receiving antenna pattern 3 and the inner peripheral edge 6. As a result, the window glass antennas according to the present invention provide frequency vs. sensitivity characteristics C1, C2, C4, C6, C7 which are close to the frequency vs. sensitivity characteristic of the receiving antenna pattern 3 itself. Stated otherwise, the window glass antennas 1, 21, 31 have a radio signal reception sensitivity less susceptible to an electric conductor of an automobile body or a building on which they are mounted.

The illustrated window glass antennas 1, 21, 31 are designed particularly for the reception of radio signals in the FM broadcast band. However, the principles of the present invention are also applicable to a window glass antenna for receiving radio signals in other frequency bands.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

We claim:

1. A window glass antenna on a sheet of window glass having a peripheral portion extending along the entire periphery of the sheet of window glass and a central portion defined by the portion of the sheet of window glass surrounded by the peripheral portion, the sheet of window glass mounted within an opening in an electrically conductive body; the antenna comprising:

a receiving antenna pattern disposed on the peripheral portion of the sheet of window glass such that the central portion is free of any portion of said receiving antenna pattern, and spaced inwardly from the periphery of the opening of the electrically conductive body;

an electrically conductive guard pattern comprising an open loop conductor having a gap defined therein, said guard pattern encircling said receiving antenna pattern and being disposed without directly connecting to at least the receiving antenna pattern and the electrically conductive body, said guard pattern being disposed on the peripheral portion of the sheet of window glass between the periphery of the opening in the electrically conductive body and said receiving antenna pattern, said guard pattern being disposed more closely to the periphery of the opening than to said receiving antenna pattern; and said guard pattern being positioned on the sheet of window glass in close proximity to said electrically conductive body for intensive electromagnetic and electrostatic coupling between said guard pattern and the electrically conductive body thereby reducing the intensity of electromagnetic and electrostatic coupling between said receiving antenna pattern and the electrically conductive body to provide a frequency vs. sensitivity characteristic close to the frequency vs. sensitivity characteristic of said receiving antenna pattern itself.

2. A window glass antenna on a sheet of window glass having a peripheral portion extending along the entire periphery of the sheet of window glass and a central portion defined by the portion of the sheet of window glass surrounded by the peripheral portion, the sheet of window glass mounted within an opening in an electrically conductive body, the antenna comprising:

a receiving antenna pattern disposed on the peripheral portion of the sheet of window glass such that the central portion is free of any portion of the receiving antenna pattern, and spaced inwardly from the periphery of the opening of the electrically conductive body;

an electrically conductive guard pattern comprising an open loop conductor having a gap defined therein, encircling the receiving antenna pattern and being disposed without directly connecting to at least the receiving antenna pattern and the electrically conductive body, disposed on the peripheral portion of the sheet of window glass between the periphery of the opening and said receiving antenna pattern, said guard pattern being disposed more closely to the periphery of the opening than to said receiving antenna pattern, said guard pattern extending parallel to and along the periphery of the opening; and said guard pattern being positioned on the sheet of window glass in close proximity to said electrically conductive body for intensive electromagnetic and electrostatic coupling between the guard pattern and the electrically conductive body thereby reducing the intensity of electromagnetic and electrostatic coupling between said receiving antenna pattern and the electrically conductive body to provide a frequency vs. sensitivity characteristic close to the frequency vs. sensitivity characteristic of the receiving antenna pattern itself.

* * * * *

UNITED STATES PATENT AND TRADEMARK OFFICE
CERTIFICATE OF CORRECTION

PATENT NO. : 5,565,876

DATED : October 15, 1996

INVENTOR(S) : Murakami et al.

It is certified that error appears in the above-identified patent and that said Letters Patent is hereby corrected as shown below:

Col. 1, line 12: "Comprising" should read --comprising--

Col. 1, line 50: delete "an" after the word "are"

Col. 2, line 63: insert --, which is disposed as shown on a peripheral portion of the window glass that extends along the periphery of the window glass-- after the numeral "3"

Col. 2, line 64: delete "and" after the word "loop"

Col. 2, line 64: insert --thereby leaving the central portion of the glass, which is defined by the peripheral portion, free of any part of the antenna pattern. The receiving pattern-- after the word "loop"

Signed and Sealed this

Second Day of December, 1997

*Attest:*

Bruce Lehman

BRUCE LEHMAN

*Attesting Officer*

*Commissioner of Patents and Trademarks*